US009147543B2

(12) United States Patent
Horinouchi et al.

(10) Patent No.: US 9,147,543 B2
(45) Date of Patent: Sep. 29, 2015

(54) GAS CIRCUIT BREAKER

(75) Inventors: Katsuhiko Horinouchi, Tokyo (JP); Motohiro Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 151 days.

(21) Appl. No.: 13/820,333

(22) PCT Filed: Nov. 4, 2011

(86) PCT No.: PCT/JP2011/075416
§ 371 (c)(1),
(2), (4) Date: Mar. 1, 2013

(87) PCT Pub. No.: WO2012/077436
PCT Pub. Date: Jun. 14, 2012

(65) Prior Publication Data

US 2013/0161289 A1 Jun. 27, 2013

(30) Foreign Application Priority Data

Dec. 7, 2010 (JP) ..... 2010-272234

(51) Int. Cl.
*H01H 33/86* (2006.01)
*H01H 33/70* (2006.01)
(Continued)

(52) U.S. Cl.
CPC ..... *H01H 33/86* (2013.01); *H01H 33/703* (2013.01); *H01H 33/66261* (2013.01); *H01H 33/7015* (2013.01); *H01H 33/7023* (2013.01); *H01H 33/7076* (2013.01); *H01H 33/76* (2013.01)

(58) Field of Classification Search
CPC ..... H01H 33/703; H01H 33/7015; H01H 33/7061; H01H 33/66261; H01H 33/26; H01H 2033/567
USPC ..... 218/37, 41, 46, 47, 54, 90, 57
See application file for complete search history.

(56) References Cited

U.S. PATENT DOCUMENTS 2,733,316 A * 1/1956 Browne, Jr. et al. ..... 218/59
5,841,088 A * 11/1998 Yamaguchi et al. ..... 218/158
(Continued)

FOREIGN PATENT DOCUMENTS

JP 10 31945 2/1998
JP 11 329191 11/1999
(Continued)

OTHER PUBLICATIONS

International Search Report Issued Nov. 29, 2011 in PCT/JP11/75416 filed Nov. 4, 2011.
(Continued)

*Primary Examiner* — Renee S Luebke
*Assistant Examiner* — William Bolton
(74) *Attorney, Agent, or Firm* — Oblon, McClelland, Maier & Neustadt, L.L.P.

(57) ABSTRACT

An arc extinguishing device of a gas circuit breaker includes: an arc chamber in which an arc generated between a movable electrode and a fixed electrode is formed; a heat puffer chamber disposed so as to surround the arc chamber; a blow port in which the arc chamber communicates with the heat puffer chamber in the circumferential direction of the arc chamber; hydrogen absorbents which are disposed on an inner wall of a pressure chamber; an exhaust port which passes to the outside of an arc extinguishing chamber; and a hydrogen absorbent disposed at a position surrounding the movable electrode. Deterioration of insulation due to a product formed by decomposition of arc extinguishing gas by the arc during a contact opening operation can be suppressed.

10 Claims, 7 Drawing Sheets

(51) Int. Cl.
*H01H 33/662* (2006.01)
*H01H 33/76* (2006.01)

(56) References Cited

U.S. PATENT DOCUMENTS

| | | | | |
|---|---|---|---|---|
| 5,929,409 | A | 7/1999 | Zehnder et al. | |
| 6,163,001 | A | 12/2000 | Zehnder et al. | |
| 6,429,394 | B2 * | 8/2002 | Hunger et al. | 218/155 |
| 7,893,379 | B2 | 2/2011 | Schoenemann et al. | |
| 2011/0127237 | A1 * | 6/2011 | Uchii et al. | 218/46 |

FOREIGN PATENT DOCUMENTS

| | | |
|---|---|---|
| JP | 2000 67717 | 3/2000 |
| JP | 2004 164994 | 6/2004 |
| JP | 2007 189798 | 7/2007 |
| JP | 2008 525944 | 7/2008 |
| JP | 2009 99499 | 5/2009 |

OTHER PUBLICATIONS

U.S. Appl. No. 14/363,922, filed Jun. 9, 2014, Horinouchi, et al.

* cited by examiner

GAS CIRCUIT BREAKER

TECHNICAL FIELD

The present invention relates to a gas circuit breaker which interrupts a large current during the occurrence of a fault such as a short-circuit, a load current, and an energization current in normal time by blowing arc extinguishing gas.

BACKGROUND ART

In a known gas circuit breaker, in order to effectively interrupt a large current by a small operating force, the gas circuit breaker includes: a heating chamber which enhances the pressure of insulating gas using the heat of an arc; and a pair of cylinder and piston (mechanical puffer) which enhances the pressure of insulating gas by reducing a volume by a mechanical operating force. The heating chamber is a space disposed so as to surround an arc chamber between a contact tulip and an opening and closing pin with an operating axis of the opening and closing pin as a center line, and the heating chamber communicates with the arc chamber by blowing slits. During an interruption operation, pressure in the heating chamber rises by heat which is radiated passing through the blowing slits from an arc generated between the contact tulip and the opening and closing pin. Furthermore, a material constituting the blowing slits becomes evaporation gas by the heat of the arc; and accordingly, a pressure rise in the heating chamber is enhanced. The pressure rise is assisted by the supply of the insulating gas, which is compressed by the piston operating simultaneously with a contact opening operation of the opening and closing pin, to the heating chamber through a blowing path.

For example, in a known circuit breaker disclosed in Patent Document 1, in the case of crossing a next current zero point after a high pressure is generated in a heating chamber, insulating gas in the heating chamber flows from blowing slits to a discharge port provided on the opposite side of a pressure chamber with respect to an arc chamber via the arc chamber and the pressure chamber; and at the same time, the insulating gas flows into other discharge chamber on the opening and closing pin side via the arc chamber. Accordingly, a gas flow inevitably intersects with an arc and gas ionized in an intersection range is sufficiently removed; and therefore, an arc is not generated after crossing the current zero point and arc extinguishing is completed.

Furthermore, for example, in a known gas circuit breaker disclosed in Patent Document 2, in order to absorb a slight amount of moisture contained in arc extinguishing gas in the gas circuit breaker and a gas molecule formed by decomposition by an arc, an adsorbent of a porous body is laid or stored at a path where interrupting gas moves or a portion where the interrupting gas remains.

Further, for example, in a gas circuit breaker disclosed in Patent Document 3, a hydrogen absorbing alloy member is disposed in a flow path from a mechanical puffer to an arc chamber; hydrogen gas is discharged from the hydrogen absorbing alloy member overheated by an arc during a contact opening operation and the arc is cooled; and after completion of the contact opening operation, the temperature of the hydrogen absorbing alloy member decreases and the hydrogen gas is recovered again.

RELATED ART DOCUMENT

Patent Document

[Patent Document 1] Japanese Unexamined Patent Publication No. H11-329191

[Patent Document 2] Japanese Unexamined Patent Publication No. 2007-189798

[Patent Document 3] Japanese Unexamined Patent Publication No. 2000-67717

SUMMARY OF THE INVENTION

Problems to be Solved by the Invention

However, in the known circuit breaker of Patent Document 1, heated gas flows out from the arc chamber to other discharge chamber, the heated gas including: a hydrogen ion generated by evaporation of the blowing slits by the heat of the arc and a hydrogen ion generated by decomposition of a slight amount of moisture contained in the insulating gas by the arc; and a fluorine ion generated by decomposition of insulating gas by the arc when the insulating gas is gas containing fluorine. As the temperature of the heated gas decreases, the hydrogen ion combines with the fluorine ion to form hydrogen fluoride. The hydrogen fluoride has a predisposition to make an insulator corrode extremely; and therefore, a problem exists in that an insulating body, which supports a structural object to which a high voltage is applied, causes deterioration of insulation by absorbing the hydrogen fluoride.

Furthermore, heated gas flows out from the arc chamber to other discharge chamber, the heated gas including: a hydrogen ion generated by evaporation of the blowing slits by the heat of the arc and a hydrogen ion generated by decomposition of a slight amount of moisture contained in the insulating gas by the arc; and an oxygen ion generated by decomposition of insulating gas by the arc when the insulating gas is gas containing oxygen. As the temperature of the heated gas decreases, the hydrogen ion combines with the oxygen ion to form water. Water has a predisposition to make insulation deteriorate; and therefore, problems exist in that not only water makes the insulating gas lower its own insulation performance, but also water causes deterioration of insulation by attachment of water to an insulating body, which supports an structural object to which a high voltage is applied, or by adhesion of water to the insulating body.

Furthermore, in the gas circuit breaker of Patent Document 2, the porous body, which is disposed to absorb the slight amount of moisture contained in the arc extinguishing gas and the gas molecule formed by decomposition by the arc, is disposed at a location where a temperature is relatively low and the porous body cannot be brought into directly contact with high temperature heated gas; and therefore, a problem exists in that the temporal efficiency of adsorption is bad.

Furthermore, in the gas circuit breaker of Patent Document 3, although the hydrogen absorbing alloy member is disposed for the purpose of arc cooling, adsorbed hydrogen is discharged during the contact opening operation; and therefore, the hydrogen absorbing alloy member has a function that rather increases than decreases hydrogen during the contact opening operation. Further, the arrangement locations of the hydrogen absorbing alloy member are the puffer chamber, the flow path from the puffer chamber to the arc chamber, and the arc chamber; and accordingly, hydrogen in heated gas containing a hydrogen component formed by decomposition in the arc chamber cannot be absorbed and it is difficult to prevent the hydrogen compound from diffusing outside an arc extinguishing chamber. Thus, a problem exists in that deterioration of insulation is caused.

In addition, the direction of the contact opening operation of an opening and closing pin is opposite to a direction for pressing to the direction of a compression operation of a piston; and therefore, a problem exists in that an operation mechanism, which operates the opening and closing pin and the piston, is complicated.

The present invention has been made to solve the problems described above, and an object of the present invention is to provide a gas circuit breaker which suppresses deterioration of insulation caused by a product that is formed by decomposition of arc extinguishing gas by an arc during a contact opening operation, and in which an operation mechanism is simple and a reduction in size is achieved.

Means for Solving the Problems

In order to solve the above-described problems, the present invention provides a gas circuit breaker including: a fixed electrode; a movable electrode capable of being connected to and disconnected from the fixed electrode; an arc chamber in which an arc generated when the movable electrode is separated from the fixed electrode is formed; a pressure chamber in which arc extinguishing gas to be sent to the arc chamber is stored; a nozzle which guides the arc extinguishing gas from the pressure chamber to the arc chamber; and a hydrogen absorbent which is disposed in a flow path of heated gas discharged from the arc chamber during the generation of the arc.

Advantageous Effect of the Invention

According to a gas circuit breaker of the present invention, heated gas exhausted from an arc chamber comes into contact with a hydrogen absorbent and accordingly hydrogen and a hydrogen ion contained in the heated gas are adsorbed and reduced, whereby the formation of hydrogen compounds such as hydrogen fluoride that deteriorates an insulation material and water that lowers insulation can be suppressed and deterioration of insulation can be suppressed.

MODE FOR CARRYING OUT THE INVENTION

Hereinafter, gas circuit breakers according to embodiments of the present invention will be described with reference to FIG. 1 to FIG. 7.

Embodiment 1

Figure 1:
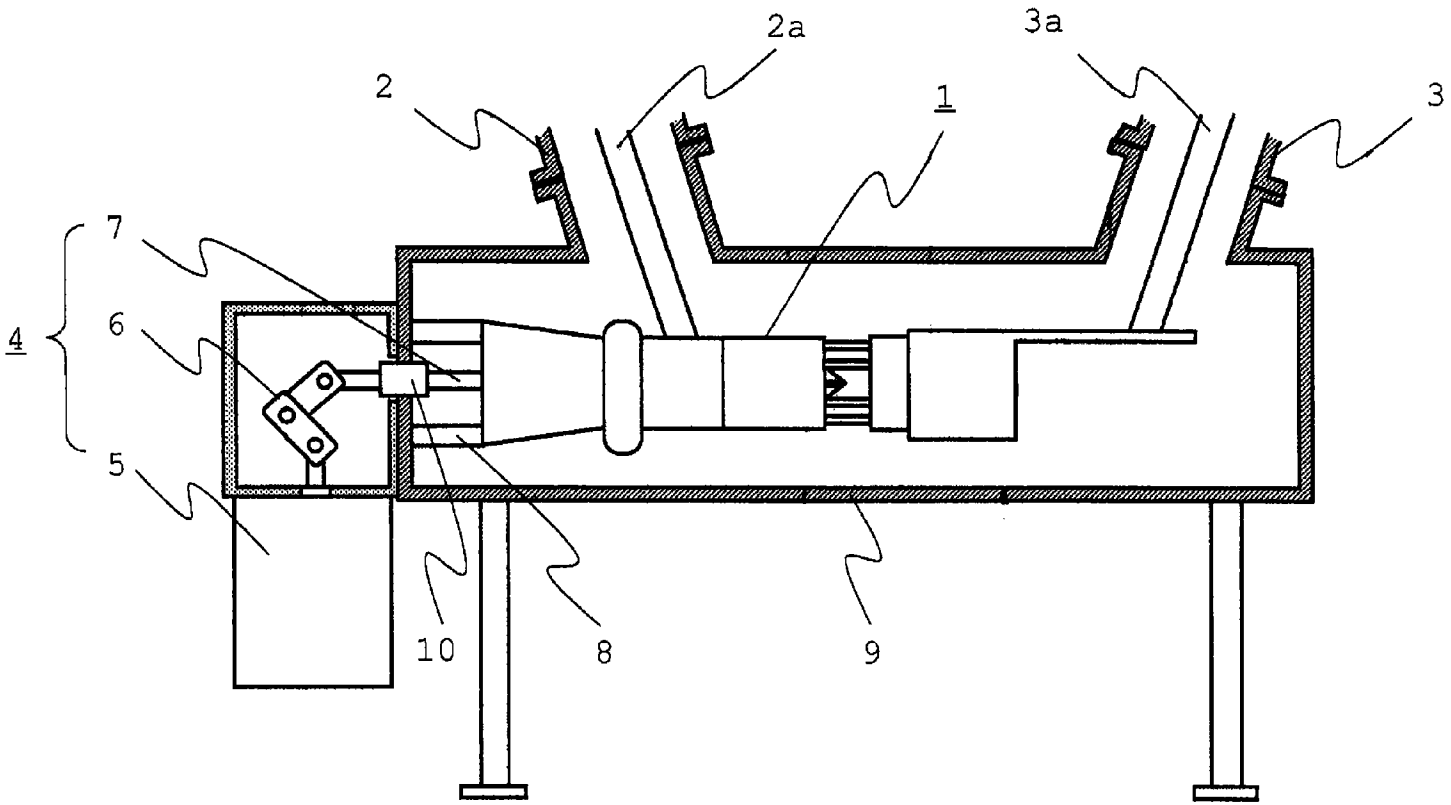
FIG. 1 is a schematic sectional view showing a gas circuit breaker according to Embodiment 1 of the present invention.
Figure 2:
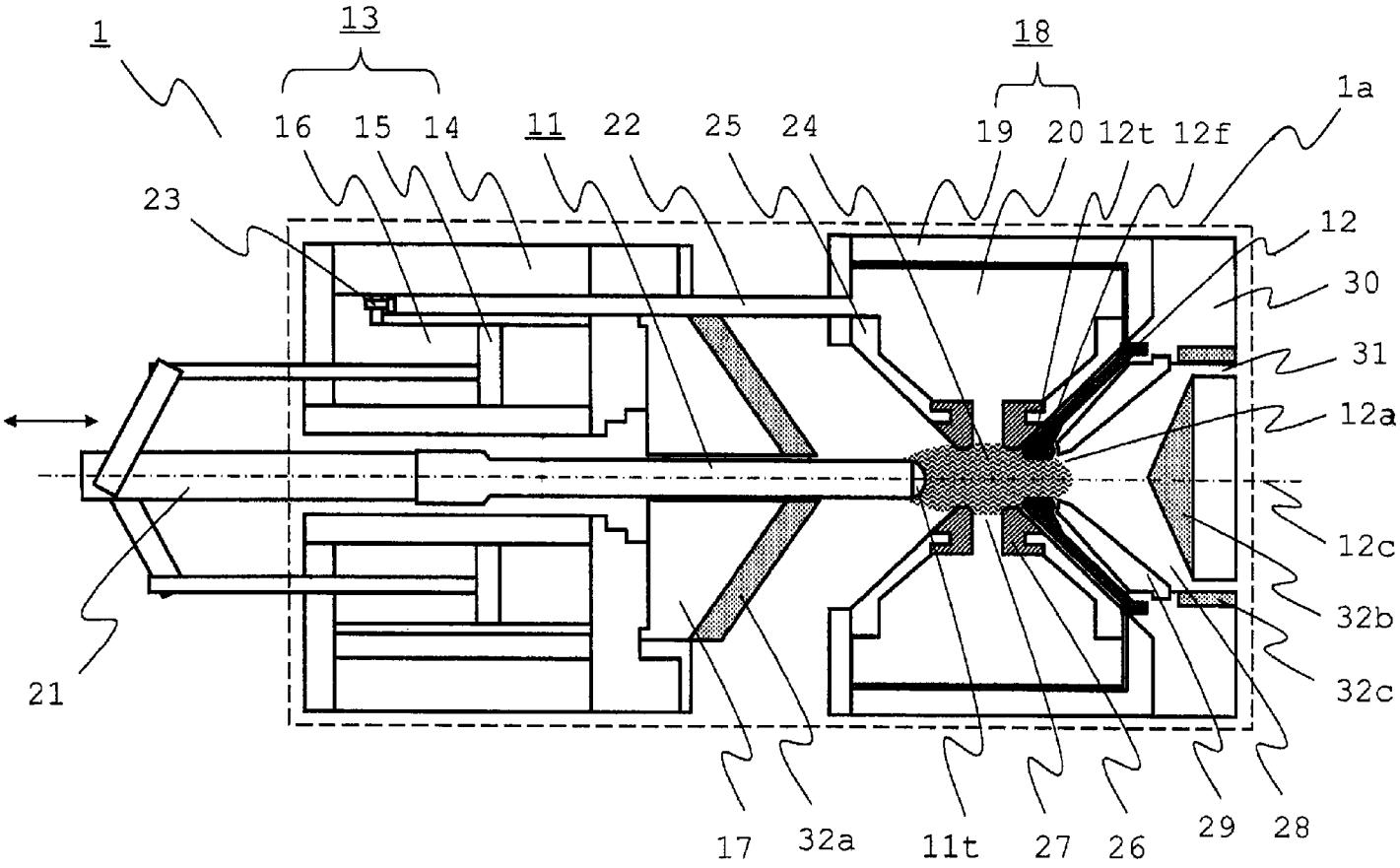
FIG. 2 is a schematic sectional view showing a major portion of an arc extinguishing device of the gas circuit breaker according to Embodiment 1 of the present invention.

FIG. 1 is a schematic sectional view showing a gas circuit breaker according to Embodiment 1 of the present invention; and FIG. 2 is a schematic sectional view showing a major portion of an arc extinguishing device of the gas circuit breaker according to Embodiment 1.

In the gas circuit breaker shown in FIG. 1, an arc extinguishing device 1 is electrically connected between a first conductor 2*a* extending from a first bushing 2 and a second conductor 3*a* extending from a second bushing 3. An operation mechanism 4 that drives a movable electrode 11 is composed of: for example, an operating device 5 which is operated by a spring mechanism, a hydraulic mechanism, or the like; a link 6; and an insulating rod 7. The movable electrode 11 is coupled to the link 6 by the rod 7 and performs a contact opening and closing operation by the operating device 5. A portion where the rod 7 is drawn from a housing 9 that seals the arc extinguishing device 1 in arc extinguishing gas is provided with a sliding component 10 having, for example, an O-ring so as to be able to slide while maintaining air tight seal. Furthermore, the arc extinguishing device 1 is supported in an insulated manner from the housing 9 by an insulation supporting body 8. Incidentally, for example, sulphur hexafluoride (SF6), carbonic anhydride (CO2), trifluoroiodomethane (CF3I), nitrogen (N2), tetra-fluoromethane (CF4), or gas mixed with at least two of these substances is used as the arc extinguishing gas.

FIG. 2 is the schematic sectional view during an interruption operation of the arc extinguishing device 1 of the gas circuit breaker according to Embodiment 1 and shows a state in which an arc is generated between a leading end portion of the separated movable electrode 11 and a leading end portion of the fixed electrode 12. The arc extinguishing device 1 includes: an arc chamber 24 in which an arc generated between the movable electrode 11 and the fixed electrode 12 is formed; a pressure chamber 28 which is provided communicating with an opening portion 12*a* on the fixed electrode 12 side of the arc chamber 24, and maintains a relative position with the fixed electrode 12 also during a contact opening and closing operation; a heat puffer chamber (heat pressure chamber) 20 which is disposed so as to surround the arc chamber 24 in the circumferential direction of an axis of the above-mentioned operation; a blow port 27 in which the arc chamber 24 communicates with the heat puffer chamber 20 in the circumferential direction of the arc chamber 24; hydrogen absorbents 32*b* and 32*c* which are disposed on the inner surface of a partition wall 30 of the pressure chamber 28, the inner surface being wider than the opening portion 12*a* and facing the opening portion 12*a*; an exhaust port 31 which is provided in the partition wall 30, and passes through from the pressure chamber 28 to the outside of an arc extinguishing chamber 1*a*; a mechanical puffer cylinder 14 which maintains a relative position with the fixed electrode 12 on the movable electrode 11 side facing the fixed electrode 12; a puffer piston 15 which is driven in the same direction as the driving direction of the movable electrode 11, and slides against the mechanical puffer cylinder 14; a mechanical puffer chamber (mechanical pressure chamber) 16 which is surrounded by the mechanical puffer cylinder 14 and the puffer piston 15; a plurality of pipes 22 which communicate between the mechanical puffer cylinder 14 and the heat puffer chamber 20; a check valve 23 which is provided on the mechanical puffer cylinder 14 side of the pipes 22; and a hydrogen absorbent 32*a* which maintains a relative position with the mechanical puffer cylinder 14, is fixed to the mechanical puffer cylinder 14 by a conductor 17, and is disposed at a position surrounding the movable electrode 11.

In FIG. 2, a center line 12*c* of the rod shaped fixed electrode 12 serves as an operating axis of the movable electrode 11. The fixed electrode 12 is, for example, a contact tulip including a plurality of elastic contact fingers 12*f*; and the contact fingers 12*f* are disposed in a radial shape along the side surface of a truncated cone protruding on the movable electrode 11 side with the operating axis as a central axis, and are separated by slits.

A mechanical puffer 13 electrically connected to the first conductor 2*a* in FIG. 1 passes along the movable electrode 11 to which a potential is applied by the conductor 17 slidable with the movable electrode 11. The movable electrode 11 constitutes a pair of contacts with the tulip shaped fixed electrode 12. The fixed electrode 12 is electrically connected to the second conductor 3*a* and is the same potential as the second conductor 3*a*. The mechanical puffer 13, a heat puffer 18, and the fixed electrode 12 are fixed to a structure that supports the arc extinguishing device 1 by predetermined means; and the movable electrode 11 is driven by the operation mechanism 4 and accordingly the contact opening and closing operation is performed.

The puffer piston 15 is inserted in the mechanical puffer cylinder 14 and a space surrounded by the mechanical puffer cylinder 14 and the puffer piston 15 constitutes the mechanical puffer chamber 16.

A configuration is made such that the puffer piston 15 is fastened to an operating rod 21 connected to the movable electrode 11; and a contact opening operation of the movable electrode 11 and the fixed electrode 12 and an operation of drawing the puffer piston 15 from the mechanical puffer cylinder 14 can be performed at the same time by only driving the movable electrode 11 to the contact opening direction, and the operation mechanism 4 can be of a simple configuration. Further, an object to be driven is the movable electrode 11 and the puffer piston 15; and accordingly, a reduction in weight can be achieved and the operating force of the operating device 5 can be reduced.

The puffer piston 15 is drawn; and accordingly, the volume of the inside of the mechanical puffer chamber 16 is reduced to compress gas therein and its pressure rises.

The heat puffer chamber 20 is connected to the mechanical puffer cylinder 14 by the plurality of pipes 22. The check valve 23 that stops a flow from the heat puffer chamber 20 to the mechanical puffer cylinder 14 is provided on each of the plurality of pipes 22 on the mechanical puffer cylinder 14 side of the pipe 22.

The arc chamber 24 is an arc generation space defined by leading end portions 12*t* of the contact fingers 12*f* constituting the fixed electrode 12 and a leading end portion 11*t* of the movable electrode 11, and is surrounded by the annular heat puffer chamber 20 from the circumferential direction of the direction the above-mentioned operation. The wall surface on the inner circumferential side of the heat puffer chamber 20 is constituted by a nozzle 25 and a guide 26 and a section of the heat puffer chamber 20 is a wedge shape; and the ring shaped blow port 27 is provided on the guide 26 positioned at this wedge apex. The outer circumference of the heat puffer chamber 20 is constituted by a tube shaped outer circumferential wall 19; and the maximum dimension of the arc extinguishing device 1 is defined by the diameter of the outer circumferential wall 19.

The pressure chamber 28 is a space surrounded by a protective cover 29 and the partition wall 30, the protective cover 29 being a conical side surface shape provided in order to prevent heated gas from flowing in from the slits each between the contact fingers 12*f* of the fixed electrode 12; and the pressure chamber 28 communicates with the arc chamber 24 by the opening portion 12*a* surrounded by the leading end portions of the fixed electrode 12. Further, the pressure chamber 28 is a conically shaped space provided between the partition wall 30 and the heat puffer chamber 20 using a conical space in which the inner circumferential side of the annular heat puffer chamber 20 is recessed, and the inner surface of the partition wall 30 facing the opening portion 12*a* is wider than the opening portion 12*a*. A reduction in size in the longitudinal direction of the arc extinguishing device 1 is achieved by such a configuration. The exhaust port 31 is provided in the partition wall 30, and the heated gas remained in the pressure chamber 28 is exhausted from the exhaust port 31.

The hydrogen absorbents 32*a*, 32*b*, and 32*c*, which absorb a hydrogen atom, a hydrogen ion or hydrogen molecule (hereinafter, named generically as hydrogen) and a hydrogen compound, are disposed at the position surrounding the movable electrode 11 and the inner surface of the partition wall 30 facing the opening portion 12*a* of the pressure chamber 28. The hydrogen absorbents 32*a*, 32*b*, and 32*c* are a metal such as palladium (Pd), titanium (Ti), zirconium (Zr), magnesium (Mg), and nickel (Ni). These hydrogen absorbents 32*a*, 32*b*, and 32*c* have performance that absorbs hydrogen equal to or larger than their own volume. Furthermore, the hydrogen absorbents 32*a*, 32*b*, and 32*c* absorb hydrogen most efficiently at about from 200° C. to 1500° C. On the other hand, a melting point is about 2000° C.; and therefore, the arrangement of the hydrogen absorbents placed at the position at temperature equal to or lower than the melting point is preferable.

The guide 26 may use a material that easily evaporates by the heat of an arc for the purpose of increasing the pressure of the heat puffer chamber 20. At this time, in the case where the material is made of an insulator of an organic compound such as a substance containing hydrogen H, for example, polyacetal (POM), acrylic resin (PMMA), polyethylene (PE), urea resin (UF), and melamine resin, hydrogen is generated when such material is decomposed by the heat of the arc. Furthermore, moisture contained slightly in insulation arc extinguishing gas is also decomposed by the arc and hydrogen is generated.

For example, in the case where gas containing fluorine F is used for the insulation arc extinguishing gas like SF6 gas, as the generated hydrogen H is cooled and its temperature decreases, the hydrogen combines with fluorine F to form hydrogen fluoride HF, the fluorine F being generated by decomposition of the arc extinguishing gas by an arc. This hydrogen fluoride HF is extremely high in corrosiveness; and the hydrogen fluoride HF deteriorates an insulator or the like for use at a place where the arc extinguishing device 1 is supported, and lowers dielectric strength. However, the hydrogen absorbents 32*a*, 32*b*, and 32*c* are provided; and accordingly, the generation of HF can be suppressed by absorbing hydrogen before lowering to a temperature at which HF is formed, and an effect that prevents deterioration of insulation can be obtained. Furthermore, in the case where gas containing oxygen O such as CO2 is used for the arc extinguishing gas, oxygen O combines with hydrogen H to form water H2O. When water is generated, insulation deteriorates; however, the generation of water can be suppressed by the hydrogen absorbents 32*a*, 32*b*, and 32*c* by absorbing hydrogen before lowering to a temperature at which water is formed; and deterioration of insulation can be prevented. Further, as shown in FIG. 2, the hydrogen absorbents 32*a*, 32*b*, and 32*c* are disposed at positions on which heated gas containing hydrogen blown from the arc chamber 24 impinges directly; and accordingly, hydrogen can be efficiently absorbed.

Next, a current interruption operation of the arc extinguishing device 1 of the gas circuit breaker according to Embodiment 1 of the present invention will be described. First, when a contact opening command is given to the gas circuit breaker in a close contact state, the operating device 5 starts up to drive the movable electrode 11 (to the left side in FIG. 2), and the movable electrode 11 is separated from the fixed electrode 12 to generate an arc in the arc chamber 24. In the case of a relatively large current such as a short-circuit current, heat generated by the arc flows into the heat puffer chamber 20 through the blow port 27. Accordingly, the pressure of the heat puffer chamber 20 rises. Furthermore, in the case where an evaporable material is applied to the guide 26, the pressure of the heat puffer chamber 20 rises to a higher pressure by decomposed gas that is generated by being evaporated by decomposition by the heat of the arc. Further, at the same time, the puffer piston 15 slides against the mechanical puffer cylinder 14; and therefore, arc extinguishing gas in the mechanical puffer chamber 16 is compressed and its pressure rises.

An alternating current repeats a maximum value and a zero value of the current for every half cycle; and therefore, a current value of the arc is also small in a period of time when the current reduces from the maximum value to the zero value, especially near the zero value, and an amount of generated heat is also small. Therefore, in this time domain, the pressure of the heat puffer chamber 20 is higher than that of the arc chamber 24, and the arc extinguishing gas is blown from the heat puffer chamber 20 to the arc through the blow port 27. Further, at a time when the pressure in the mechanical puffer chamber 16 is higher than that in the heat puffer chamber 20, the check valve 23 opens and the arc extinguishing gas in the mechanical puffer chamber 16 flows into the heat puffer chamber 20 through the pipes 22; and therefore, the flow of the arc extinguishing gas blown from the heat puffer chamber 20 to the arc through the blow port 25 is enhanced.

In FIG. 2, the arc extinguishing gas blown from the heat puffer chamber 20 to the arc through the blow port 27 is divided into the direction of the fixed electrode 12 corresponding to the right side and the direction of the movable electrode 11 corresponding to the left side; and accordingly, it brings about an effect to divide the arc and heated gas having a high temperature, which is heated by the arc, is exhausted from right and left two openings. Thus, the heated gas can be exhausted at a high efficiency.

The heated gas flown out to the fixed electrode 12 side is discharged from the opening portion 12*a* of the fixed electrode 12 to the pressure chamber 28. The heated gas comes into contact with the hydrogen absorbents 32*b* and 32*c* disposed in front of the partition wall 30, and hydrogen contained in the heated gas is adsorbed to reduce the amount of hydrogen. The pressure chamber 28 is a conically shaped and relatively wide space enlarging from the opening portion 12*a* toward the inner surface of the partition wall 30; a flow path formed by the shape of the conical hydrogen absorbent 32*b* and the cylindrical hydrogen absorbent 32*c* reduces flow path resistance of a flow from the fixed electrode 12 toward the pressure chamber 28, promptly exhausts the heated gas from the arc chamber 24, and expands the heated gas; and accordingly, the temperature can be lowered to a temperature at which the hydrogen absorbents 32*b* and 32*c* can efficiently absorb.

Whereas, the heated gas flown out to the movable electrode 11 side comes into contact with the hydrogen absorbent 32*a* disposed around the movable electrode 11. Accordingly, hydrogen contained in the heated gas is adsorbed to reduce the amount of hydrogen. The heated gas in which the amount of hydrogen is reduced changes the direction of a flow to a radial direction. The flow path intersects with the plurality of the pipes 22; however, the heated gas from the arc chamber 24 can be exhausted without disturbing the flow by providing a sufficient interval between rows of the pipes. Further, a heat resistant material is used for the pipe 22; and accordingly, the interval between the rows of the pipes can be further enlarged by using pipes each having a narrow diameter and the heated gas can be efficiently exhausted.

In this way, the arc is extinguished by efficiently exhausting the heat between the electrodes to the outside by blowing the arc extinguishing gas to the arc, and the movable electrode 11 is separated from the fixed electrode 12 to a sufficient distance capable of withstanding against a transient recovery voltage to be appeared between the electrodes; and accordingly, insulation recovery between the electrodes is obtained and interruption is completed. More particularly, in the case of a gas circuit breaker to be applied to a high voltage system, the distance between the electrodes necessary for insulation recovery is long because the transient recovery voltage to be appeared just before completion of interruption is high; however, as described above, the heat between the electrodes is efficiently exhausted to the outside; and accordingly, the distance necessary for the insulation recovery can be shortened and it leads to a reduction in size in the longitudinal direction of the arc extinguishing device 1.

Further, the heated gas exhausted from the arc extinguishing chamber 1*a* to the outside is small in the amount of hydrogen; and therefore, the amount of gas such as hydrogen fluoride that accelerates corrosion and the amount of a hydrogen compound such as water that deteriorates insulation are small. Thus, even when the gas comes into contact with an insulator for use in the insulation supporting body 8 and the like, the generation of deterioration of insulation can be prevented.

As described above, in the gas circuit breaker according to Embodiment 1, heated gas exhausted from the arc chamber is brought into contact with the hydrogen absorbents and accordingly hydrogen and a hydrogen ion contained in the heated gas are adsorbed and reduced; and therefore, the formation of hydrogen compounds such as hydrogen fluoride that deteriorates an insulation material and water that lowers insulation can be suppressed and the deterioration of the insulation can be suppressed. That is, the hydrogen absorbents are provided on the inner surface of the partition wall facing the fixed electrode of the pressure chamber connected to the arc chamber and at the position surrounding the movable electrode; and accordingly, hydrogen, which is contained in the heated gas generated in connection with the arc that is generated during separation of the electrodes is absorbed. Thus, there is a remarkable effect in that there can be obtained a gas circuit breaker in which the generation of corrosion gas that deteriorates the insulation material and the generation of gas such as water (water vapor) that deteriorates insulation can be suppressed, the corrosion gas and the water (water vapor) being formed by combining with hydrogen, can be suppressed; the deterioration of the insulation is suppressed; the operation mechanism is simple; and a reduction in size can be achieved.

Embodiment 2

Figure 3:
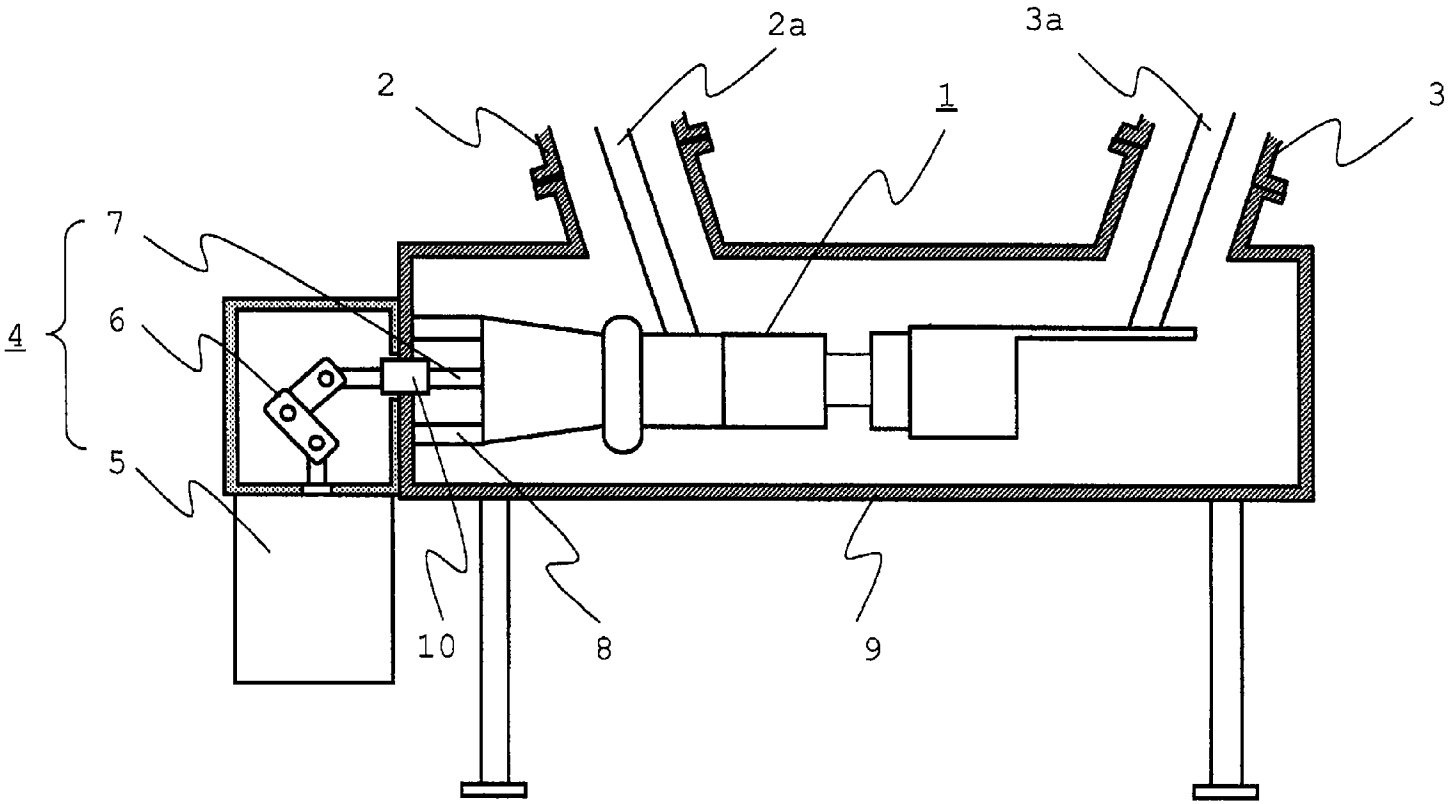
FIG. 3 is a schematic sectional view showing a gas circuit breaker according to Embodiment 2 of the present invention.
Figure 4:
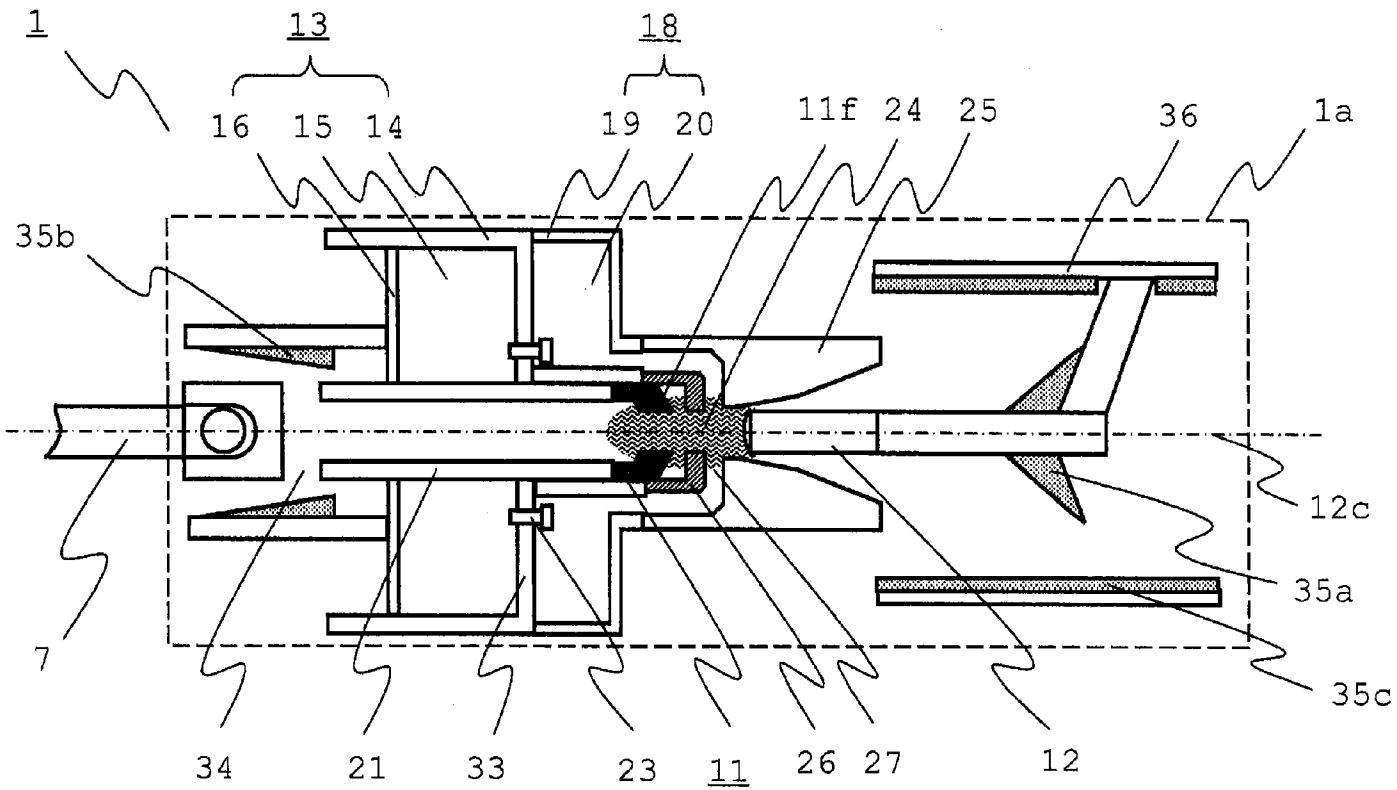
FIG. 4 is a schematic sectional view showing a major portion of an arc extinguishing device of the gas circuit breaker according to Embodiment 2 of the present invention.

FIG. 3 is a schematic sectional view showing a gas circuit breaker according to Embodiment 2 of the present invention; and FIG. 4 is a schematic sectional view showing a major portion of an arc extinguishing device of the gas circuit breaker according to Embodiment 2. The configuration of the gas circuit breaker of Embodiment 2 shown in FIG. 3 is the same as that of Embodiment 1 shown in FIG. 1 and therefore their description will be omitted.

FIG. 4 is the schematic sectional view during an interruption operation of an arc extinguishing device 1 of the gas circuit breaker according to Embodiment 2 and shows a state in which an arc is generated between a leading end portion of a separated movable electrode 11 and a leading end portion of a fixed electrode 12. The arc extinguishing device 1 includes: an arc chamber 24 in which an arc generated between the movable electrode 11 and the fixed electrode 12 is formed; an operating rod 21 which is provided communicating with the movable electrode 11 side of the arc chamber 24, and maintains a relative position with the movable electrode 11 also during a contact opening and closing operation; a mechanical puffer cylinder 14 which is disposed in the same axis as the operating rod 21 so as to surround the operating rod 21, and is fixed to the operating rod 21; a puffer piston 15 which is inserted in the mechanical puffer cylinder 14, and slides against the mechanical puffer cylinder 14 during an opening and closing operation; a mechanical puffer chamber 16 that is a space between the mechanical puffer cylinder 14 and the puffer piston 15; a cylindrically shaped heat puffer chamber 20 which is provided nearer to the arc chamber 24 than the mechanical puffer chamber 16, and is placed in the same axis as the operating rod 21; a partition wall 33 which is provided between the mechanical puffer chamber 16 and the heat puffer chamber 20; a check valve 23 which is provided on the partition wall 33; a nozzle 25 which forms a path guiding arc extinguishing gas from the heat puffer chamber 20 to the arc chamber 24; a guide 26 which is disposed so as to surround the movable electrode 11, guides the arc extinguishing gas to the arc chamber 24 together with the nozzle 25, and uses a material containing a hydrogen atom for the whole or a part thereof; an opening 34 which is provided on the side surface of the operating rod 21 at an end portion located on the opposite side of the operating rod 21 with respect to the movable electrode 11; a hydrogen absorbent 35*b* which is disposed so as to surround the opening 34; a cooling tube 36 which is coaxially disposed with the fixed electrode 12; a hydrogen absorbent 35*a* which is disposed at the inside or a termination end portion of the cooling tube 36; and a hydrogen absorbent 35*c* which is disposed on the inner surface of the cooling tube 36.

In FIG. 4, a center line 12*c* of the rod shaped fixed electrode 12 serves as an operating axis of the movable electrode 11. The movable electrode 11 is, for example, a contact tulip including a plurality of elastic contact fingers 11*f*; and the contact fingers 11*f* are disposed in an annular shape with the operating axis as a central axis, and are separated by slits (not shown in the drawing).

A potential is applied to the movable electrode 11 through the mechanical puffer cylinder 14 which is electrically connected to a first conductor 2*a* in FIG. 3 in a slidable manner. The movable electrode 11 constitutes a pair of contacts with the fixed electrode 12. The fixed electrode 12 is electrically connected to a second conductor 3*a* and is the same potential as the second conductor 3*a*. A mechanical puffer 13, a heat puffer 18, and the movable electrode 11 are fixed to the cylindrically shaped operating rod 21 and are driven by an operation mechanism 4 via the operating rod 21; and accordingly, a contact opening and closing operation is performed.

The mechanical puffer cylinder 14 is a cylinder with the operating rod 21 as the central axis. The puffer piston 15 is inserted in the mechanical puffer cylinder 14 and a space surrounded by the mechanical puffer cylinder 14 and the puffer piston 15 constitutes the mechanical puffer chamber 16. The puffer piston 15 is fixed to a structure that supports the arc extinguishing device 1; and when the movable electrode 11 is drive in a contact opening direction, arc extinguishing gas in the mechanical puffer chamber 16 is compressed and its pressure rises.

The heat puffer chamber 20 is disposed in a direction toward the fixed electrode 12 from the mechanical puffer chamber 16 via the partition wall 33. The heat puffer chamber 20 is a space surrounded by a cylindrical outer wall 19 with the operating rod 21 as the central axis. A communication port is formed in the partition wall 33 provided between the mechanical puffer chamber 16 and the heat puffer chamber 20; and the check valve 23 is provided on the partition wall 33 and prevents the arc extinguishing gas from flowing from the heat puffer chamber 20 to the mechanical puffer chamber 16.

The nozzle 25 is provided in a direction toward the fixed electrode 12 from the heat puffer chamber 20; and the arc extinguishing gas is guided from the heat puffer chamber 20 into the arc chamber 24 that is a space between the movable electrode 11 and the fixed electrode 12 via a space between the nozzle 25 and the guide 26 disposed so as to surround the movable electrode 11. In the case where a material containing a hydrogen atom is used for the whole or a part of the nozzle 25 and the guide 26, the nozzle 25 and the guide 26 are evaporated by the heat of the arc; and accordingly, the hydrogen atom and a hydrogen ion are contained in the arc extinguishing gas and heated gas.

The heated gas generated from the inside of the arc chamber 24 passes through the inside of the cylindrically shaped operating rod 21 from the movable electrode 11; and the heated gas is exhausted from the opening 34 to an outside space, the opening 34 being opened on the side surface of the operating rod 21 at the end portion located on the opposite side of the operating rod 21 with respect to the movable electrode 11. The hydrogen absorbent 35*b* is disposed near the opening 34 in a manner surrounding the opening 34. The heated gas exhausted from the operating rod 21 impinges on the hydrogen absorbent 35*b*; and accordingly, hydrogen is reduced.

Whereas, the heated gas discharged from the arc chamber 24 toward the fixed electrode 12 passes through the inside of the cylindrically shaped cooling tube 36 placed in the same axis as the fixed electrode 12 and is exhausted to the outside of an arc extinguishing chamber 1*a* that is a region where the arc extinguishing device 1 is disposed. The hydrogen absorbents 35*a* and 35*c* are disposed in the direction of a heated gas flow path. In FIG. 4, there is shown an example in which the hydrogen absorbent 35*a* is disposed inside the cooling tube 36; however, the hydrogen absorbent 35*a* may be disposed at an end portion of the cooling tube 36. Such an arrangement is most effective when the hydrogen absorbent 35*a* and 35*c* are disposed at positions where the heated gas lowers to a temperature at which a hydrogen compound is formed. The hydrogen absorbents 35*a* and 35*c* are arranged; and accordingly, hydrogen contained in the heated gas is reduced.

In this way, the hydrogen absorbents 35*a*, 35*b*, and 35*c* are disposed at the flow path of the heated gas and accordingly the amount of the hydrogen contained in the heated gas is reduced; and the formation of hydrogen fluoride and water, each of which is a hydrogen compound, can be suppressed. Thus, an effect can be obtained in that deterioration of insulation of insulators is prevented.

Figure 5:
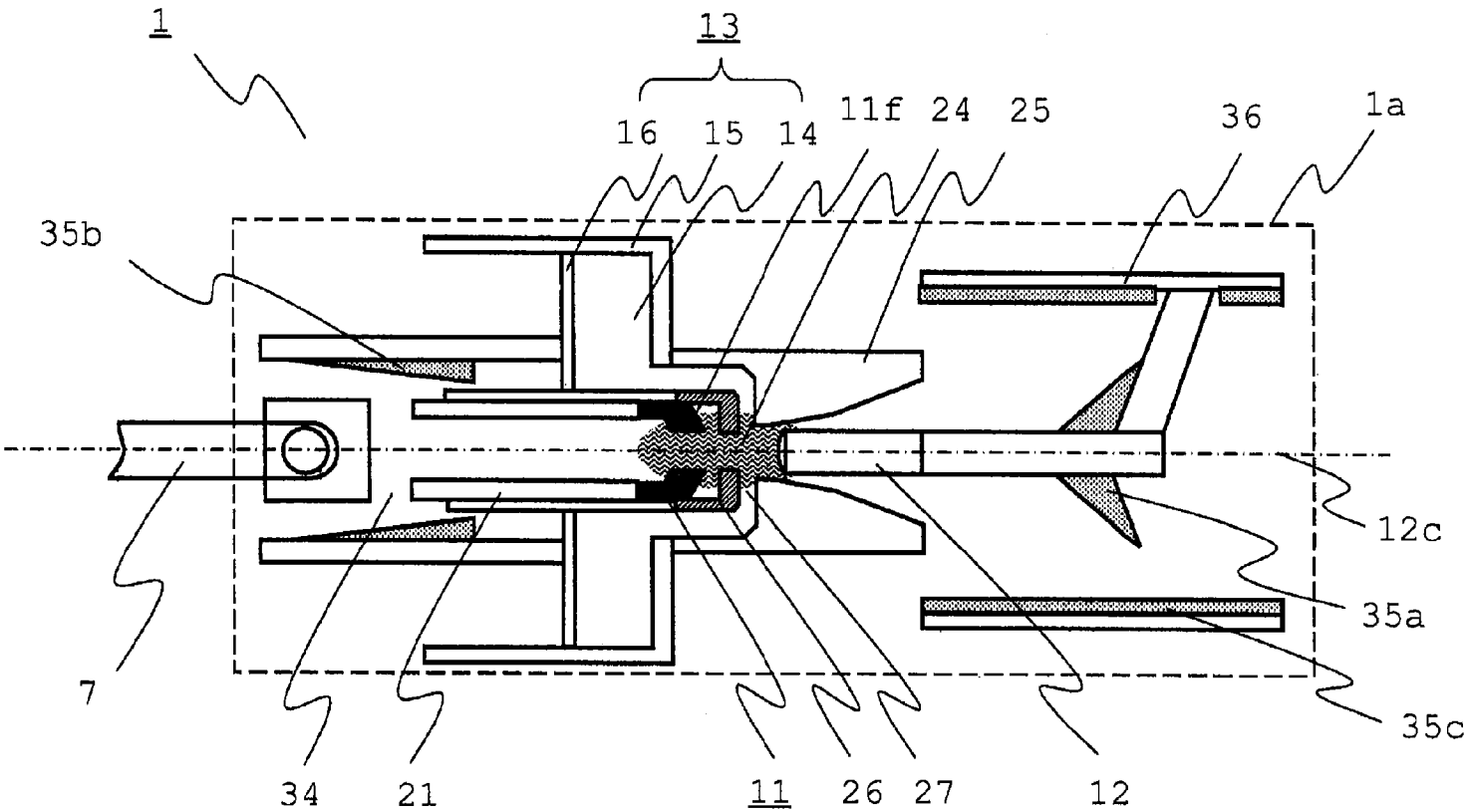
FIG. 5 is a schematic sectional view showing a different example of a major portion of an arc extinguishing device of the gas circuit breaker according to Embodiment 2 of the present invention.

Incidentally, this example shows an example in which the heat puffer 18 is provided; however, as shown in FIG. 5, similar effects can be obtained even in the case of being configured by only a mechanical puffer 13.

Figure 6:
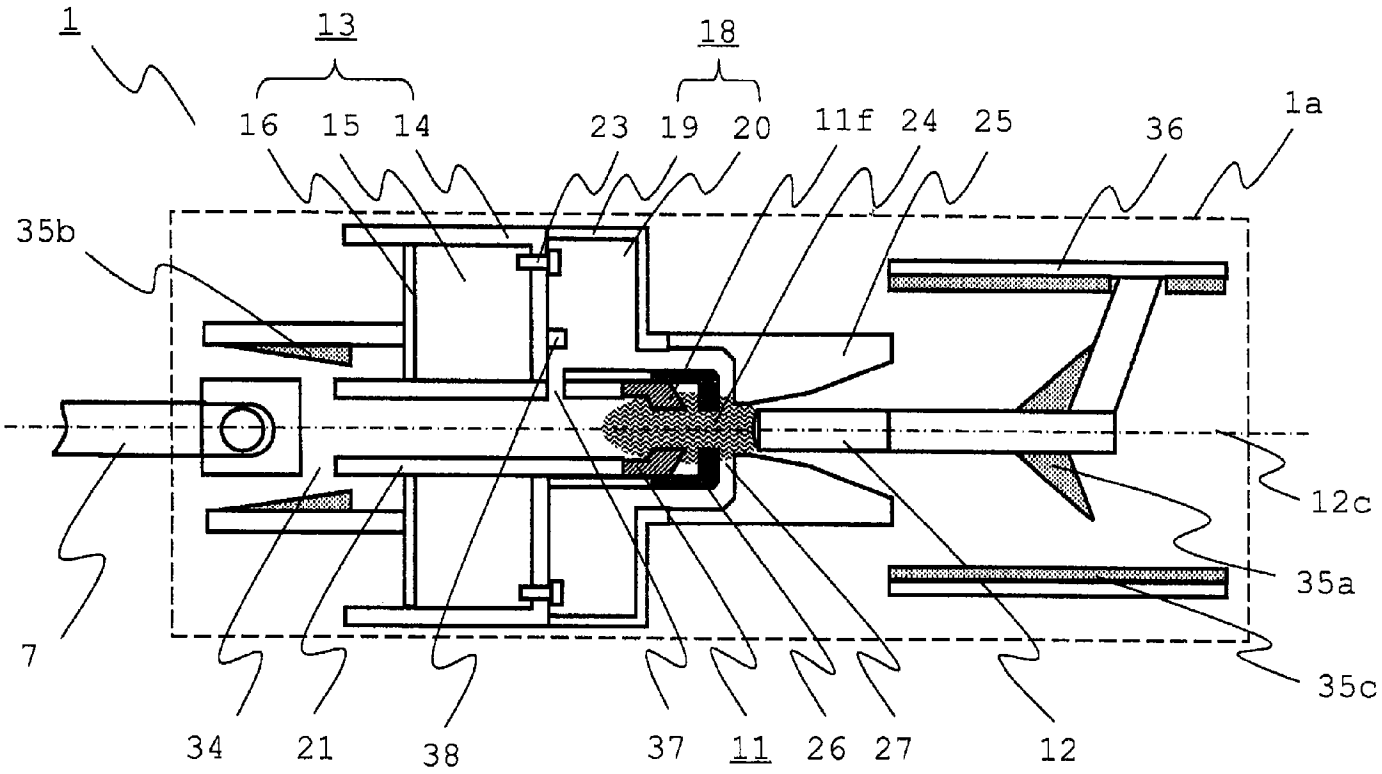
FIG. 6 is a schematic sectional view showing a further different example of a major portion of an arc extinguishing device of the gas circuit breaker according to Embodiment 2 of the present invention.

Furthermore, there is shown an example in which a material containing a hydrogen atom is used for the whole or a part of the nozzle 25 and the guide 26; however, as shown in FIG. 6, even in the case where a feed back path 37 from an operating rod 21 to a heat puffer chamber 20 is provided and a member 38, which is evaporated by the heat from the feed back path 37, is made of a material containing a hydrogen atom, hydrogen absorbents 35*a*, 35*b*, and 35*c* are used; and accordingly, similar effects are exhibited and an effect can be obtained in that deterioration of insulation of insulators is prevented.

As described above, in the gas circuit breaker according to Embodiment 2, as in Embodiment 1, heated gas exhausted from the arc chamber is brought into contact with the hydrogen absorbents and accordingly hydrogen and a hydrogen ion contained in the heated gas are adsorbed and reduced; and therefore, the formation of hydrogen compounds such as hydrogen fluoride that deteriorates an insulation material and water that lowers insulation can be suppressed and the deterioration of the insulation can be suppressed. That is, the hydrogen absorbents are provided on the side surface of the opening of the operating rod, on the inside or the termination end portion of the cooling tube coaxially disposed with the fixed electrode, and on the inner surface of the cooling tube; and accordingly, hydrogen, which is contained in the heated gas generated in connection with the arc that is generated during separation of the electrodes is absorbed. Thus, there is a remarkable effect in that there can be obtained a gas circuit breaker in which the generation of corrosion gas that deteriorates the insulation material and the generation of gas such as water (water vapor) that deteriorates insulation can be suppressed, the corrosion gas and the water (water vapor) being formed by combining with hydrogen, can be suppressed; the deterioration of the insulation is suppressed; the operation mechanism is simple; and a reduction in size can be achieved.

Embodiment 3

Figure 7:
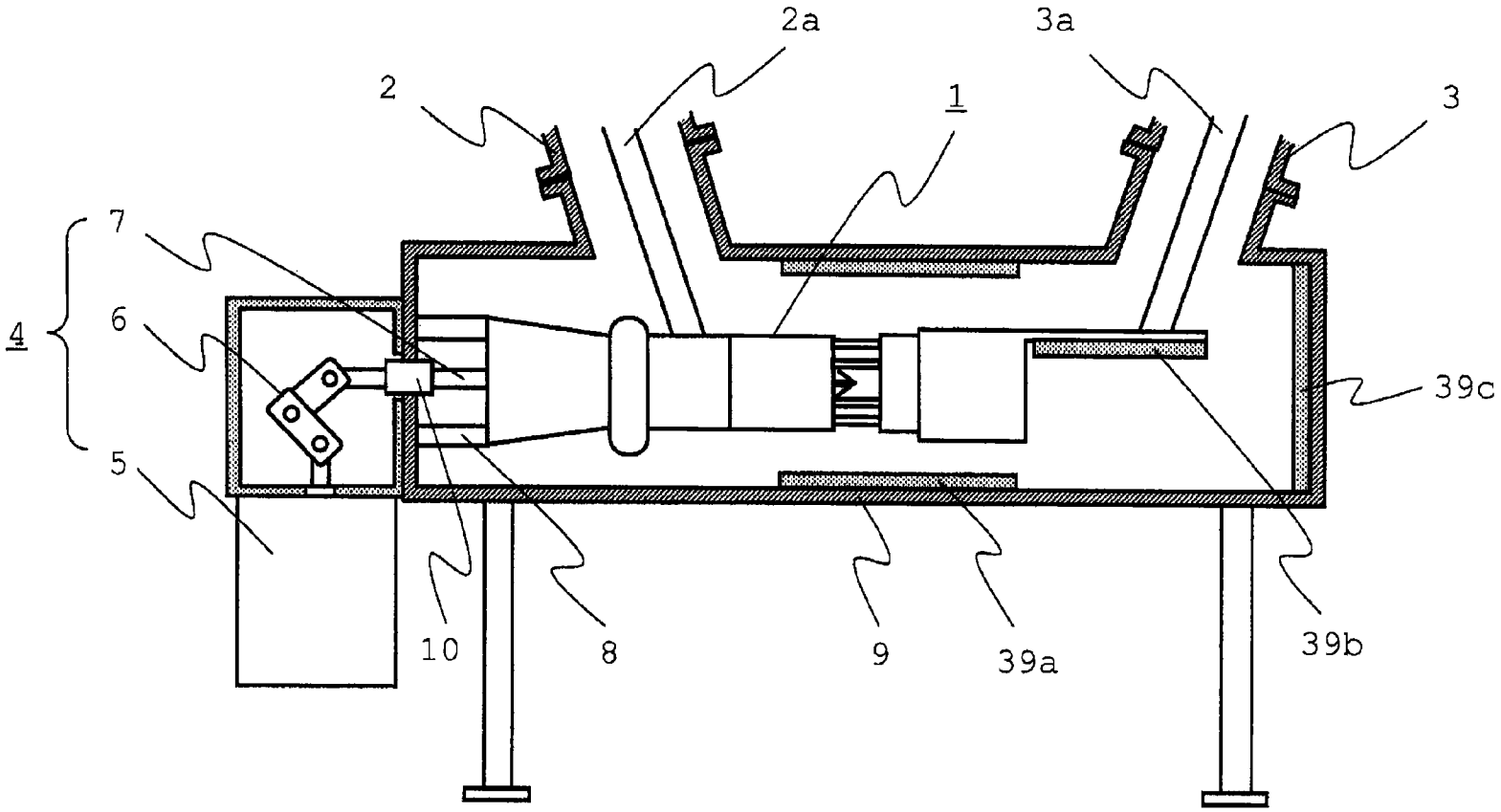
FIG. 7 is a schematic sectional view showing a gas circuit breaker according to Embodiment 3 of the present invention.

FIG. 7 is a schematic sectional view showing a gas circuit breaker according to Embodiment 3 of the present invention. An arc extinguishing device in the gas circuit breaker of Embodiment 3 shown in FIG. 7 is the arc extinguishing device of Embodiment 1 or Embodiment 2 and the configuration and operation thereof are similar; and therefore, their description will be omitted.

In the gas circuit breaker shown in FIG. 7, an arc extinguishing device 1 is electrically connected between a first conductor 2*a* extending from a first bushing 2 and a second conductor 3*a* extending from a second bushing 3. An operation mechanism 4 that drives a movable electrode 11 is composed of: for example, an operating device 5 which is operated by a spring mechanism, a hydraulic mechanism, or the like; a link 6; and an insulating rod 7. The movable electrode 11 is coupled to the link 6 by the rod 7 and performs a contact opening and closing operation by the operating device 5. A portion where the rod 7 is drawn from a housing 9 that seals the arc extinguishing device 1 in arc extinguishing gas is provided with a sliding component 10 having, for example, an O-ring so as to be able to slide while maintaining air tight seal. Furthermore, the arc extinguishing device 1 is supported in an insulated manner from the housing 9 by an insulation supporting body 8. Further, a hydrogen absorbent 39*a* is disposed on the inner surface of the housing 9 serving as a flow path of heated gas exhausted from the arc extinguishing device 1; a hydrogen absorbent 39*b* is disposed on the surface of a fixed side heated gas flow path of the arc extinguishing device 1; and a hydrogen absorbent 39*c* is disposed on the wall surface of the housing 9 in the direction of the fixed side heated gas flow path, respectively. Incidentally, for example, sulphur hexafluoride (SF6), carbonic anhydride (CO2), trifluoroiodomethane (CF3I), nitrogen (N2), tetra-fluoromethane (CF4), or gas mixed with at least two of these substances is used as the arc extinguishing gas.

In the gas circuit breaker of Embodiment 3 shown in FIG. 7, the heated gas exhausted from the arc extinguishing device 1 comes into contact with the hydrogen absorbent 39*a* disposed on the inner surface of the housing 9, the hydrogen absorbent 39*b* disposed in the fixed side heated gas flow path, and the hydrogen absorbent 39*c* disposed on the wall surface of the housing 9 in the direction of the fixed side heated gas flow path. Accordingly, hydrogen contained in the heated gas is adsorbed and the amount of hydrogen is reduced; and therefore, the amount of gas such as hydrogen fluoride that accelerates corrosion and the amount of a hydrogen compound such as water that deteriorates insulation are small. Thus, even when the heated gas comes into contact with an insulator for use in the insulation supporting body B and the like, the generation of deterioration of insulation can be prevented.

As described above, in the gas circuit breaker according to Embodiment 3, the hydrogen absorbents are also disposed at portions such as a housing inner wall of the gas circuit breaker, the portions coming into contact with the heated gas. Accordingly, heated gas exhausted from the arc extinguishing device is brought into contact with the hydrogen absorbents; and accordingly, hydrogen and a hydrogen ion contained in the heated gas are adsorbed and reduced. Thus, together with the effects in Embodiment 1 and Embodiment 2, there is a remarkable effect in that the formation of hydrogen compounds such as hydrogen fluoride that deteriorates an insulation material and water that lowers insulation can be suppressed; and deterioration of the insulation can be suppressed.

Incidentally, in the present invention, the respective embodiments can be freely combined and appropriately changed or omitted within the scope of the present invention.

Incidentally, the same reference numerals as those shown in the drawings represent the same or corresponding elements.

DESCRIPTION OF REFERENCE NUMERALS

1 Arc extinguishing device
1*a* Arc extinguishing chamber
11 Movable electrode
12 Fixed electrode
13 Mechanical puffer
14 Mechanical puffer cylinder
15 Puffer piston
16 Mechanical puffer chamber
17 Conductor
18 Heat puffer
20 Heat puffer chamber
22 Pipe
23 Check valve
24 Arc chamber
25 Nozzle
26 Guide
28 Pressure chamber
32*a*, 32*b*, 32*c*, 39*a*, 39*b*, and 39*c* Hydrogen absorbent
36 Cooling tube
37 Feed back path
38 Evaporation member

The invention claimed is:

1. A gas circuit breaker comprising:

a fixed electrode;

a movable electrode capable of being connected to and disconnected from said fixed electrode;

an arc chamber in which an arc generated when said movable electrode is separated from said fixed electrode is formed;

a puffer chamber in which arc extinguishing gas to be sent to said arc chamber is stored;

a nozzle which guides the arc extinguishing gas from said puffer chamber to said arc chamber; and a hydrogen absorbent which absorbs at least one of a hydrogen atom, a hydrogen ion, and a hydrogen molecule and is disposed in a flow path of heated gas discharged from said arc chamber during the generation of the arc, wherein the hydrogen absorbent is disposed at a position facing an opening portion of the arc chamber.

2. The gas circuit breaker according to claim 1, further comprising a guide which guides the arc extinguishing gas to said arc chamber together with said nozzle, said nozzle or said guide being made of an insulation material containing a hydrogen atom.

3. The gas circuit breaker according to claim 1, wherein said hydrogen absorbent is disposed at a position where the direction of the flow of the heated gas changes.

4. The gas circuit breaker according to claim 1, wherein said hydrogen absorbent is disposed at a region where the temperature of the heated gas is in a state higher than a temperature at which a hydrogen atom or a hydrogen ion contained in the heated gas combines with other ion or atom to form a compound.

5. The gas circuit breaker according to claim 1, wherein said hydrogen absorbent is disposed at a region where the temperature of the heated gas is in a state equal to or lower than the heat resistant temperature of said hydrogen absorbent.

6. The gas circuit breaker according to claim 1, wherein said puffer chamber is provided in plural numbers and a plurality of said puffer chambers communicate with a plurality of pipes; and the heated gas is exhausted through between rows of said pipes.

7. The gas circuit breaker according to claim 1, further comprising:

a cooling tube having a cylindrical shape and disposed in a same axis as the fixed electrode, wherein an additional hydrogen absorbent is disposed inside of the cooling tube.

8. The gas circuit breaker according to claim 1, further comprising:

a housing surrounding the fixed electrode, the moveable electrode, the arc chamber, the puffer chamber, the nozzle, and the hydrogen absorbent, wherein an additional hydrogen absorbent is disposed on an inner surface of the housing.

9. The gas circuit breaker according to claim 1, further comprising a partition wall having an exhaust port defining a portion of the flow path, wherein an additional hydrogen absorbent is disposed on an inner surface of the partition wall defining the exhaust port.

10. The gas circuit breaker according to claim 1, wherein the hydrogen absorbent includes:

a first hydrogen absorbent having a surface, coming into contact with the flow path, that is disposed at a position facing the opening portion of the arc chamber;

a second hydrogen absorbent having a surface, coming into contact with the flow path, that is disposed at a position facing the opening portion of the arc chamber;

the first hydrogen absorbent is disposed on one of a fixed electrode side and a moveable electrode side with respect to the arc chamber; and the second hydrogen absorbent is disposed on the other of the fixed electrode side and the moveable electrode side with respect to the arc chamber.

* * * * *